US007526993B2

(12) United States Patent
Hiroki et al.

(10) Patent No.: US 7,526,993 B2
(45) Date of Patent: May 5, 2009

(54) FLUID PRESSURE CYLINDER APPARATUS HAVING THROTTLE VALVE

(75) Inventors: Akira Hiroki, Tsukubamirai (JP); Tadashi Ishii, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 215 days.

(21) Appl. No.: 11/480,931

(22) Filed: Jul. 6, 2006

(65) Prior Publication Data

US 2007/0017363 A1 Jan. 25, 2007

(30) Foreign Application Priority Data

Jul. 25, 2005 (JP) ..... 2005-214656

(51) Int. Cl.
*F15B 15/22* (2006.01)

(52) U.S. Cl. ..... 91/394; 251/209

(58) Field of Classification Search ..... 91/394, 91/395; 251/209

See application file for complete search history.

(56) References Cited

U.S. PATENT DOCUMENTS 2,556,698 A * 6/1951 Loewe ..... 91/395
2,861,769 A * 11/1958 Schumann ..... 251/209
3,231,234 A * 1/1966 Williamson ..... 251/209
3,443,793 A * 5/1969 Hulsey ..... 251/209
6,279,451 B1 8/2001 Hirano et al.

FOREIGN PATENT DOCUMENTS

CN 1351235 A 5/2002
CN 1107809 C 5/2003
EP 1201805 B1 8/2006

* cited by examiner

*Primary Examiner*—F. Daniel Lopez
(74) *Attorney, Agent, or Firm*—Oblon, Spivak, McClelland, Maier & Neustadt, P.C.

(57) ABSTRACT

A cylindrically shaped valve rod is housed in a valve hole formed in a cylinder body in a manner so as to be rotatable around a center axis line, and a connecting hole having a first hole opening that is allowed to communicate with a first flow path hole, and a second hole opening that is allowed to communicate with a second flow path hole is formed in the valve rod. A flow adjusting groove that is extending in a circumferential direction around an outer periphery of the valve rod from a position of the first hole opening is formed, and the flow adjusting groove is formed such that a groove width gradually narrows toward a tip end side and the groove depth gradually shallows at the same time, so that the valve opening extent is adjusted along with rotating operation of the valve rod.

8 Claims, 5 Drawing Sheets

FLUID PRESSURE CYLINDER APPARATUS HAVING THROTTLE VALVE

TECHNICAL FIELD

The present invention relates to a fluid pressure cylinder apparatus having a throttle valve, in which a fluid pressure cylinder is provided with a throttle valve, and a movement control of a piston is performed by means of adjusting a flow of pressurized fluid with the throttle valve.

BACKGROUND ART

Hitherto, as this kind of fluid pressure cylinder apparatus having a throttle valve, an apparatus in which a moving speed of a piston is controlled by adjusting a flow of pressurized fluid supplied to or discharged from a pressure chamber with a throttle valve, an apparatus in which the piston is stopped at an end of stroke in a buffered manner by means of limiting a flow of fluid discharged from a pressure chamber with a throttle valve when the piston approaches the end of the stroke, or the like is known.

In such a cylinder apparatus, generally, as the throttle valve, a variable throttle valve configured to adjust a square measure of an opening of an orifice by advancing and retreating a cone-shaped valve rod is used and the variable throttle valve is attached to a cylinder body.

In FIG. 9, a main part of the conventional fluid pressure cylinder apparatus provided with such a variable throttle valve 50 is illustrated. This cylinder apparatus includes a cushion chamber 56 other than a pressure chamber 52 in an inner part of a cylinder body 51, in which the cushion chamber 56 is interrupted from the pressure chamber 52 by means of a collaborative action of a rod 54 and a sealing member 55 when the piston 53 approaches the end of the stroke, whereas the cushion chamber 56 is allowed to communicate with the pressure chamber 52 when the piston 53 is in the middle of the stroke, and a port (not shown) is formed so as to be allowed to communicate with the cushion chamber 56. In addition, after the cushion chamber 56 is interrupted from the pressure chamber 52, the fluid in the pressure chamber 52 flows into the cushion chamber 56 via a through-hole 58*b* from a through-hole 58*a*, while receiving a limit of flow by the throttle valve 50, and is discharged from the port. Thereby, the piston 53 is configured to be stopped at the end of the stroke in the buffered manner.

The throttle valve 50 is constructed such that a valve holder 60 is attached to a valve hole 59 formed in the cylinder body 51, and a valve rod 61 provided with a cone-shaped adjusting portion 61*a* at a tip end thereof is movably mounted in the valve holder 60 in an advancing and retreating manner in a direction of an axis line of the valve hole 59 upon rotating operation. In addition, at a base end portion 61*b* where a male screw of the valve rod 61 is provided, a lock nut 63 for preventing the valve rod 61 from being rotated by vibration or the like after the square measure of the opening is adjusted is attached.

In the conventional fluid pressure cylinder apparatus, the throttle valve attached to the cylinder body is configured to adjust the square measure of the opening of the orifice by means of advancing and retreating the valve rod in the direction of the axis line. Accordingly, a dimension of the valve rod in a direction along the axis line is large, and in addition, an operating area for advancing and retreating the valve rod has to be secured. Consequently, there has been a large limitation on downsizing.

Further, there has also been a problem that when the valve rod, the valve holder, the lock nut, or the like is widely protruding outward of the cylinder body, it tends to be impeditive for treating the cylinder, or for attaching other devices in the vicinity of the cylinder.

DISCLOSURE OF INVENTION

An object of the present invention is to provide a fluid pressure cylinder apparatus having a throttle valve configured for a throttle valve to be compactly attached to a cylinder body by means of miniaturizing and simplifying the throttle valve.

So as to achieve the above-described object, according to the present invention, the fluid pressure cylinder apparatus having a throttle valve, including a piston moving in an inner part of a cylinder body by means of action of the fluid pressure, a pressure chamber for exerting the action of the fluid pressure on the piston, a port for supplying or discharging a pressurized fluid to the pressure chamber and a variable throttle valve for adjusting a flow of the pressurized fluid so as to control a movement of the piston is provided. The throttle valve includes a cylindrically shaped valve rod housed in a circular valve hole formed in the cylinder body in a condition of being hooked in a direction of a center axis line of the valve hole, while being rotatable around the center axis line of the valve hole. A first flow path hole and a second flow path hole for the pressurized fluid is opened at a side face and a bottom face of the valve hole, and the valve rod is formed such that an outer peripheral surface is formed in a manner so as to be in close sliding contact with an inner peripheral surface of the valve hole. Further, a connecting hole whose first hole opening at one end is opened at a side face of the valve rod and is allowed to communicate with the first flow path hole, and a second hole opening at the other end is opened at a bottom face of the valve rod and is allowed to communicate with the second flow path hole is formed in an inner part of the valve rod. Furthermore, a flow adjusting groove for adjusting a connected square measure of the first flow path hole and the first hole opening along with a rotating operation is provided at an outer periphery of the valve rod, and the flow adjusting groove extends in a circumferential direction from a position of the first hole opening as a base end and a groove width gradually narrows toward a tip end side and a groove depth gradually shallows at the same time.

In the present invention, the valve rod is preferable to be disposed in the valve hole in a non-protruding condition, and a device for hooking the valve rod in the valve hole is preferable to be a ring-shaped stopping ring.

In a concrete embodiment of the present invention, the throttle valve is provided with a function as a speed control valve for controlling a moving speed of the piston, and either one of the first flow path hole or the second flow path hole is allowed to communicate with the port, and the other is allowed to communicate with the pressure chamber.

In another concrete embodiment of the present invention, the throttle valve is configured to be provided with a function as a cushion valve for stopping the piston at an end of a stroke in a buffered manner, and when the piston approaches the end of the stroke, a fluid in the pressure chamber at a discharge side is discharged from the port through the throttle valve.

More in detail, a cushion chamber is formed in an inner part of the cylinder body, in which when the piston is in the middle of the stroke, the cushion chamber is allowed to communicated with the pressure chamber, whereas the cushion chamber is interrupted from the pressure chamber when the piston approaches the end of the stroke. Further the port is allowed to communicate with the cushion chamber and one and the other of the first flow path hole and the second flow path hole of the throttle valve are respectively allowed to communicate with the cushion chamber and the pressure chamber.

According to the present invention, since the throttle valve for adjusting a flow is configured such that the flow can be adjusted only by rotating the valve rod around its axis line in the valve hole, the throttle valve can be constructed at a compact and simple structure with small number of parts in comparison with the conventional throttle valve that advances and retreats the valve rod in a direction of the axis line, and the throttle valve can be compactly assembled in the fluid pressure cylinder.

BRIEF DESCRIPATION OF THE DRAWINGS

Figure 4A:
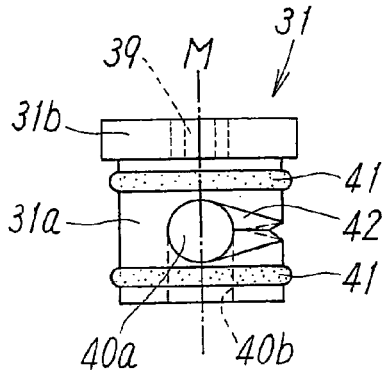

FIG. 4*a* is an elevation showing a valve rod in a throttle valve.

Figure 4B:
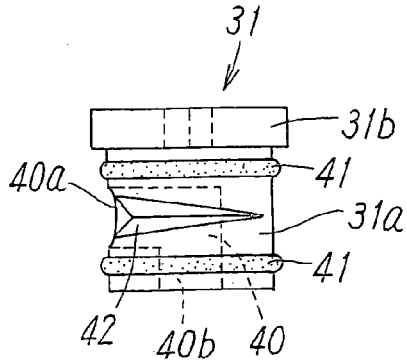

FIG. 4*b* is a side elevation showing the valve rod in the throttle valve.

Figure 5:
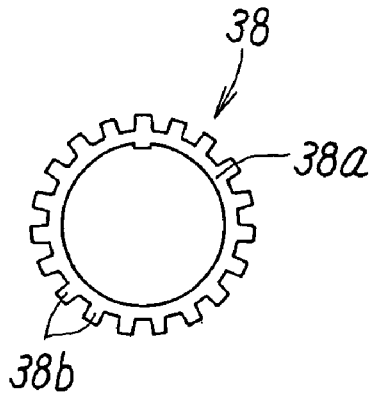

FIG. 5 is a plan view showing a hooking member.

Figure 6A:
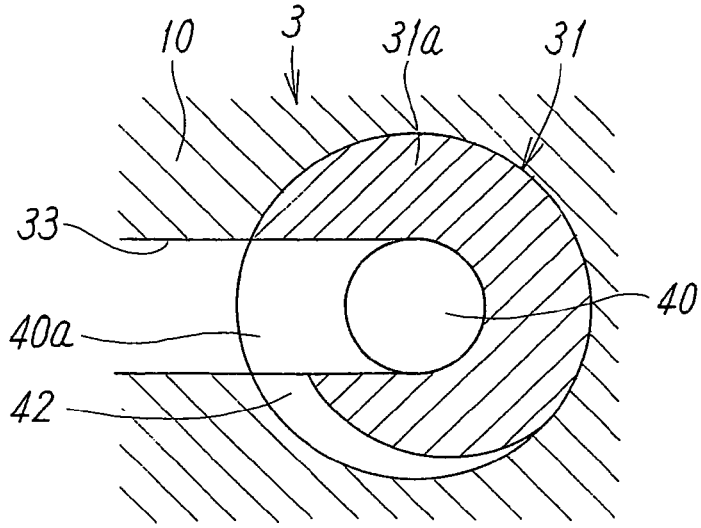

FIG. 6*a* is a cross-section showing the throttle valve when in a fully open condition.

Figure 6B:
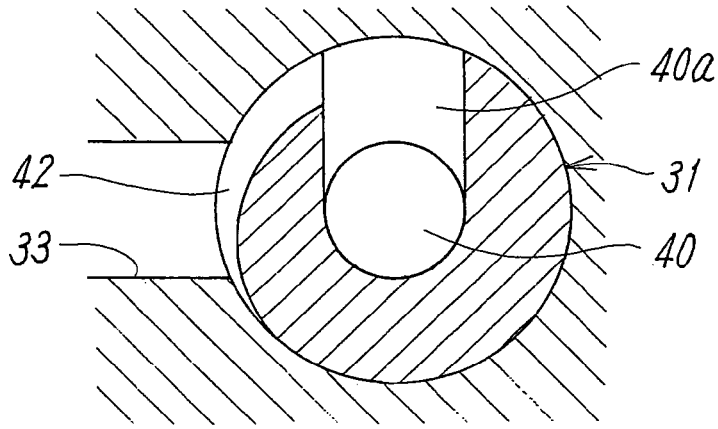

FIG. 6*b* is a cross-section showing the throttle valve when in the half open condition.

Figure 6C:
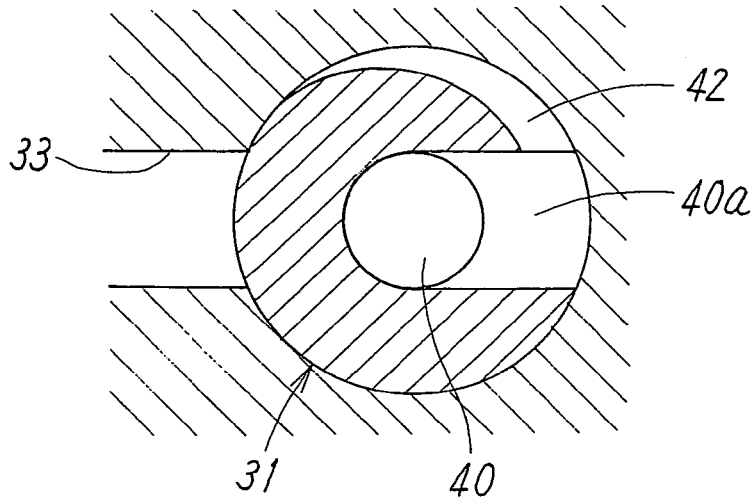

FIG. 6*c* is a cross-section showing the throttle valve when in a fully closed condition.

Figure 7:
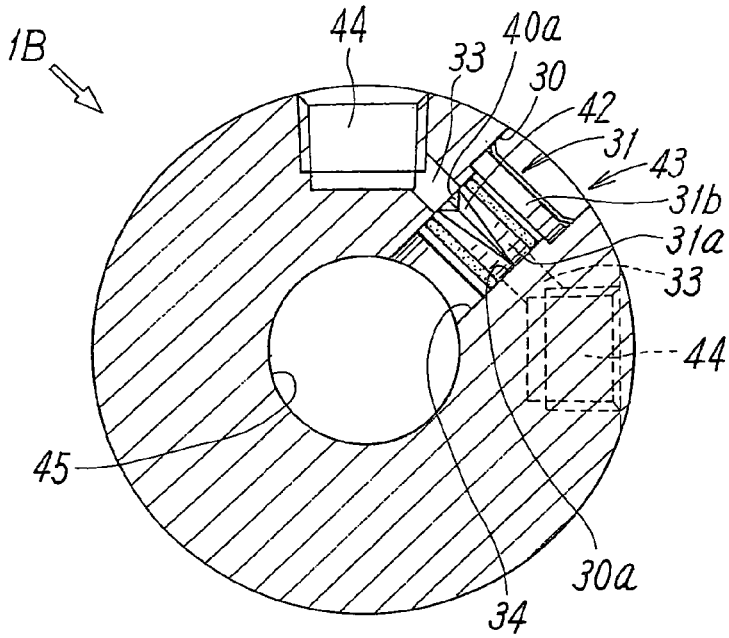

FIG. 7 is a cross-section showing a main part in the second embodiment.

Figure 8:
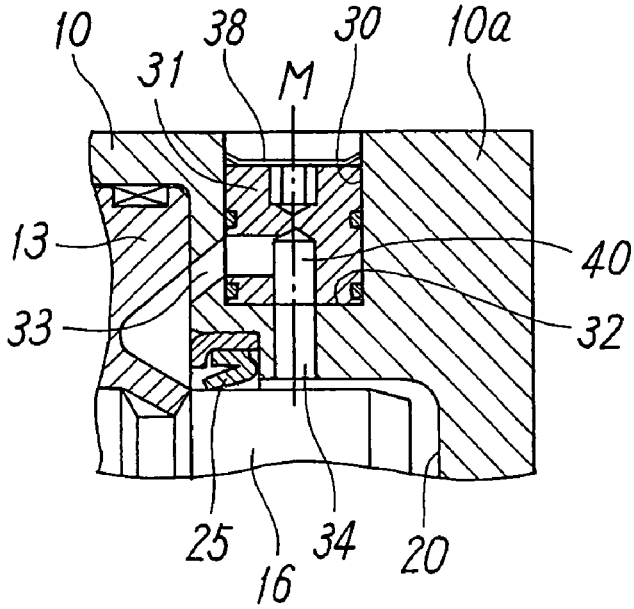

FIG. 8 is a cross-section showing a main part in the third embodiment.

Figure 9:
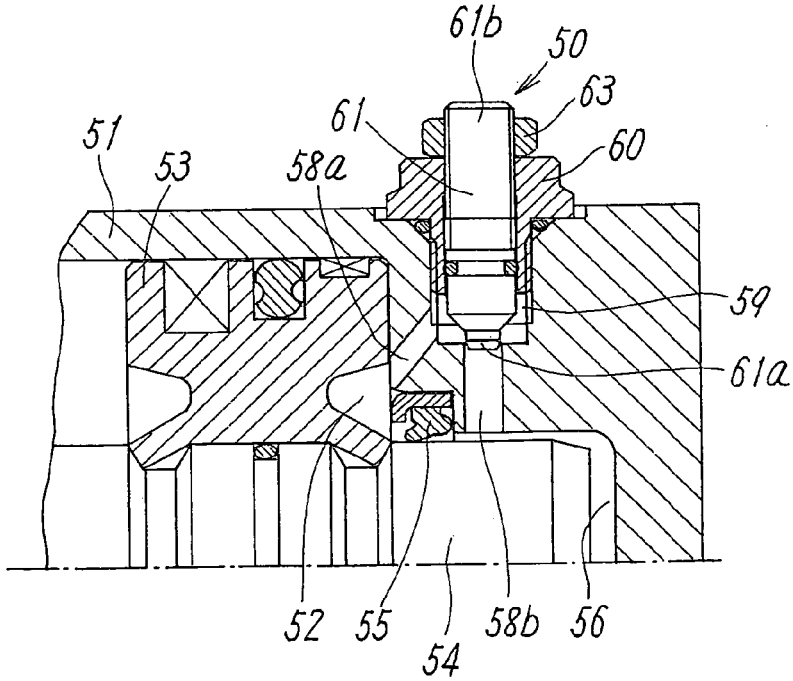

FIG. 9 is a cross-section showing a construction of a conventional variable throttle valve.

BEST MODE FOR CARRYING OUT THE INVENTION

Figure 1:
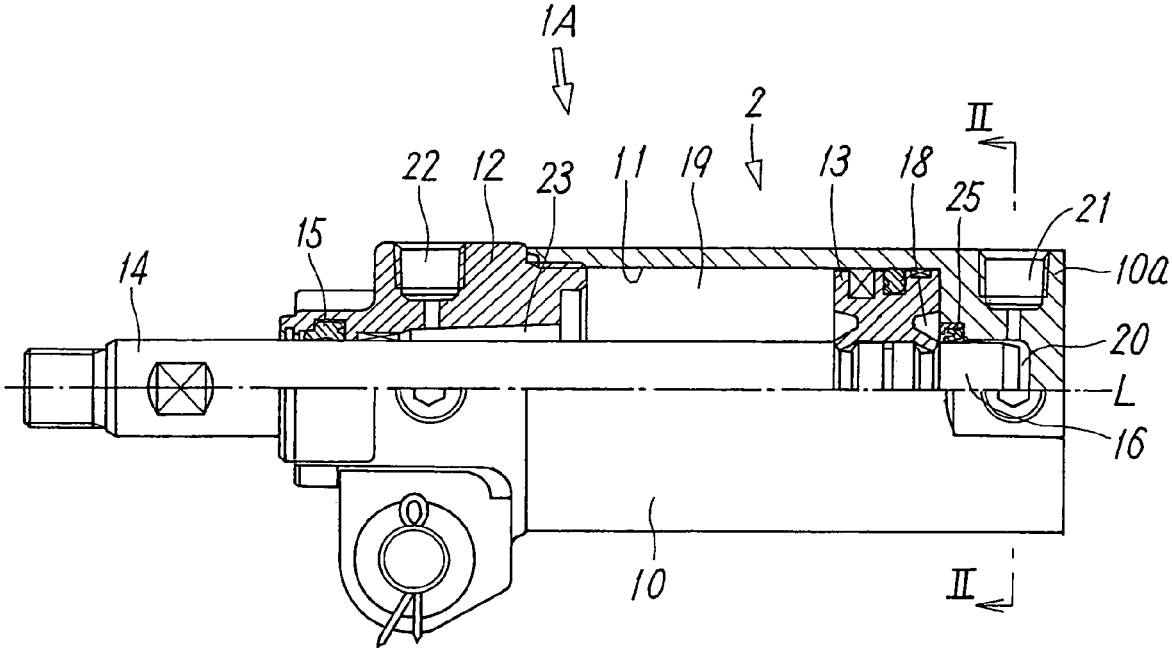
FIG. 1 is a partial cross-section showing the first embodiment of the present invention.
Figure 2:
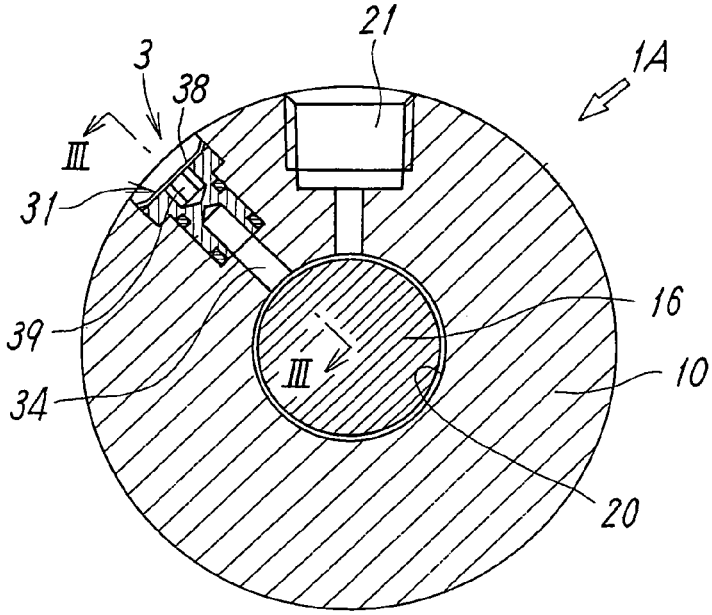
FIG. 2 is a cross-section along II-II line in FIG. 1.
Figure 3:
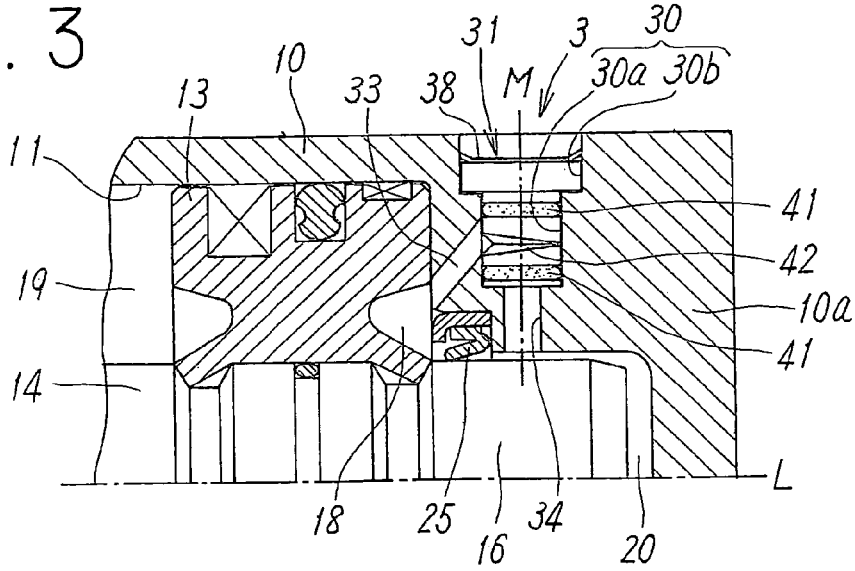
FIG. 3 is a cross-section along III-III line in FIG. 2.

FIGS. 1 through 3 show the first embodiment of a fluid pressure cylinder apparatus having a throttle valve, and a cylinder apparatus 1A of the first embodiment is constructed such that a variable throttle valve 3 for controlling a movement of a piston 13 by means of adjusting a flow of pressurized fluid is attached to a fluid pressure cylinder 2, and the piston 13 is stopped at an end of the stroke in a buffered manner by means of causing to function the throttle valve 3 as a cushion valve.

As is clear from FIG. 2, the fluid pressure cylinder 2 includes a cylinder body 10 having a circular cross-section, and a circular cylinder hole 11 that is extending in a direction of an axis line L is formed in an inner part of the cylinder body 10. One end of the cylinder hole 11 is closed by an end wall 10*a* that is integrally formed with the cylinder body 10, and the other end thereof is opened. The end portion of the cylinder hole 11 being opened is sealed by an end cover 12, which is air-tightly attached to an end portion of the cylinder body 10. Further, the piston 13 is movably housed in the direction of the axis line L, to be moved by means of action of fluid pressure, in an inner part of the cylinder hole 11. Furthermore, the shape of the cross-section of the cylinder body 10 may be a rectangular shape.

A piston rod 14 is extended from one end of the piston 13 in the direction of the axis line L, and the piston rod 14 is protruding outward while slidably penetrating the end cover 12. A numeral 15 denotes a sealing member attached to the end cover 12, for sealing a gap between the end cover 12 and an outer peripheral surface of the piston rod 14. In addition, at the other end of the piston 13, a sealing member 16 for interrupting between a first pressure chamber 18, described later, and a cushion chamber 20 when in a cushioning action is extended in the direction of the axis direction L. The sealing member 16 is integrally formed with the piston rod 14, and is formed by means of causing part of the piston rod 14 to be extended from the piston 13. The length of the sealing member 16 is short, and is in an extent of about one fourth of a hole-length of the cylinder hole 11, in an example of the illustration.

At both ends of the piston 13, two of the first and second pressure chambers, 18 and 19, for exerting the action of the fluid pressure to the piston 13 are formed. In the above, the first pressure chamber 18 is formed between the piston 13 and the end wall 10*a*, and is allowed to communicate with the cushion chamber 20 having a small diameter, which is formed at the end wall 10*a*. The first pressure chamber 18 is allowed to communicate with a first port 21 formed at a side surface of the cylinder body 10 through the cushion chamber 20. The throttle valve 3 is provided in a manner so as to intervene in a flow path that connects the first pressure chamber 18 and the cushion chamber 20 as described later in detail. On the other hand, the second pressure chamber 19 is formed between the piston 13 and the end cover 12, and is allowed to communicate with a rod insertion hole 23 formed in the end cover 12. The second pressure chamber 19 is allowed to communicate with a second port 22 formed at a side surface of the end cover 12 through the rod insertion hole 23.

Accordingly, when the second pressure chamber 19 is thrown open outward through the second port 22 from a movement condition shown in FIG. 1 and the pressurized fluid such as air or the like is supplied to the first pressure chamber 18 from the first port 21 through the cushion chamber 20, the piston 13 and the piston rod 14 are moved (advanced) in a left direction shown in FIG. 1. Further, when the cushion chamber 20 and the first pressure chamber 18 are thrown open outward through the first port 21, and the pressurized fluid is supplied to the second pressure chamber 19 from the second port 22, the piston 13 and the piston rod 14 are moved (retreated) in a right direction shown in FIG. 1.

Furthermore, when the piston 13 approaches an end of the stroke in the retreating stroke of the piston 13, as shown in FIG. 1, the sealing member 16 fits into the cushion chamber 20, and is in sliding contact with a cushion packing 25 attached to an inner peripheral surface of the cushion chamber 20 in an air-tight manner. Thereby, the cushion chamber 20 and the first pressure chamber 18 are interrupted from each other. As a result, the fluid in the first pressure chamber 18 that is freely discharged from the first port 21 through the cushion chamber 20 until then is brought to be discharged through the cushion chamber 20 and the first port 21 in a condition for the flow thereof to be limited because of flowing through the throttle valve 3. Accordingly, a cushioning action is created by this operation and the piston 13 stops at the end of the stroke in the buffered manner.

The cushion packing 25 is a lip-type seal having a one-way sealing function, and interrupts a flow of the fluid in the reverse direction, i.e., the flow that is directed from the first pressure chamber 18 to the cushion chamber 20 in a condition being in contact with an outer periphery of the sealing member 16, whereas the cushion packing 25 allows the flow in the forward direction, i.e., the flow that is directed from the cushion chamber 20 to the first pressure chamber 18. Accordingly, when the pressurized fluid is supplied from the first port 21 to the cushion chamber 20 at a time when the piston 13 is advanced from the movement condition shown in FIG. 1, the pressurized fluid freely flows into the first pressure chamber 18 while pushing open the cushion packing 25. The starting up operation is thereby smoothly performed.

The variable throttle valve 3 is attached to a side face of the cylinder body 10 and is constructed as follows. That is, as clear from FIG. 3, at a side face of the end wall 10*a* of the cylinder body 10, a circular valve hole 30 is formed in a direction orthogonal to the axis line L of the cylinder body 10 in a manner so as to be directed to a center of the cushion chamber 20, and a cylindrically shaped valve rod 31 is attached in the valve hole 30.

The valve hole 30 is composed of a small diameter hole portion 30*a* positioned at a backside of the valve hole 30 and a large diameter hole portion 30*b* positioned outside the valve hole 30. At a side face of the small diameter hole portion 30*a*, a first flow path hole 33 connected to the first pressure chamber 18 is opened, and at a center position of a bottom face of the small diameter hole portion 30*a*, a second flow path hole 34 connected to the cushion chamber 20 is opened.

On the other hand, the valve rod 31 is, as clear from FIGS. 4*a* and 4*b*, composed of a main shaft portion 31*a* having a small diameter, which fits into the small diameter hole portion 30*a* in a condition of being in closely sliding contact with an inner peripheral surface of the small diameter hole portion 30*a*, and an operating portion 31*b* having a large diameter, which fits into the large diameter hole portion 30*b* in a non-protruding condition. The valve rod 31 is disposed in the valve hole 30 in a condition that the valve rod 31 is hooked at the valve hole 30 in a direction of a center axis line M of the valve hole 30, whereas the valve rod 31 is capable of being freely rotated around the center axis line M of the valve hole 30 (namely, a center axis line of the valve rod 31). Further, an operating hole 39 having an angular hole shape, such as for example, a hexagonal hole, or the like for rotating operation using a tool, such as a wrench, or the like is formed at center portion of a top face of the operating portion 31*b*.

As a hooking device for hooking the valve rod 31 in the valve hole 30, a hooking member 38 composed of a ring-shaped stopping ring shown in FIG. 5 is used in the illustrated embodiment. The hooking member 38 is composed of a ring-shaped main body portion 38*a* and a plurality of hooking pieces 38*b* extending like a spokes of a wheel from an outer periphery of the main body portion 38*a*. These hooking pieces 38*b* are elastically hooked on a hole wall of the valve rod 30 outward, and the main body portion 38*a* is slidably in contact with an upper face of the valve rod 31. In this case, it is preferable that a jaw portion formed of a groove or a step where a tip end of the main body portion 38*a* is hooked is formed at the valve wall of the valve rod 30.

However, the hooking device is not limited to the member that is separately formed like the hooking member 38. For example, a construction in which a hooking groove in a circumferential direction is formed in an inner peripheral surface of the valve rod 30, and a projection formed on an outer periphery of the valve rod 31 is movably hooked on the hooking groove may be applicable.

In an inner part of the valve rod 31, a connecting hole 40 for connecting the first flow path hole 33 and the second flow path hole 34 is formed. A first hole opening 40*a* of one end of the connecting hole 40 is opened at a position between two sealing members, 41 and 41, at a side face of the main shaft portion 31*a*, and is capable of communicating with the first flow path hole 33. A second hole opening 40*b* of the other end of the connecting hole 40 is opened at a bottom face of the main shaft portion 31*a* and is allowed to constantly communicate with the second flow path hole 34.

Further, a flow adjusting groove 42 for adjusting a connected square measure of the first hole opening 40*a* of the connecting hole 40 and the first flow path hole 33 is formed on an outer peripheral surface of the main shaft portion 31*a*. The flow adjusting groove 42 extends in a circumferential direction around the outer peripheral surface of the main shaft portion 31*a* from a position of the first hole opening 40*a* as a base end, and the groove width gradually narrows toward the tip end side thereof while the groove depth gradually shallows at the same time between two of the sealing members, 41 and 41. Although a groove shape of the flow adjusting groove 42 is formed of a V-shaped cross-section in the drawing, other arbitrary cross-section shape, such as a U-shape, a concavity-shape, a trapezoid, or the like may be applicable.

The thus constructed variable throttle valve 3 adjusts the flow of the pressurized fluid by means of varying the connected square measure (valve opening extent) of the first hole opening 40*a* of the connecting hole 40 and the first flow path hole 33 upon rotating the valve rod 31. That is, as shown in FIG. 6*a*, when the first hole opening 40*a* and the first flowing path hole 33 are directly and perfectly allowed to communicate with each other, the throttle valve 3 is in a fully open condition and the flow is maximized. When the valve rod 31 is rotated clockwise as shown in FIG. 6*b*, from the above condition, the valve opening extent is gradually reduced and the flow is correspondingly limited. This is because the first hole opening 40*a* is allowed to communicate with the first flow path hole 33 through the flow adjusting groove 42. The valve opening extent at this moment becomes an amount corresponding to a cross-section area of a portion where the flow adjusting groove 42 is allowed to communicate with the first flowing path hole 33. Further, when the valve rod 31 is further rotated to reach a condition shown in FIG. 6*c*, the throttle valve 3 is brought to be a fully closed condition and the pressurized fluid is interrupted. This is because the first flow path hole 33 is closed by the main shaft portion 31*a*.

Although the valve rod 31 is configured to be held at an arbitrary operative position by means of friction force caused by getting crushed of two of the sealing members, 41 and 41, it may be configured to stop at a predetermined operative position by means of appropriate device other than the above.

Further, the valve rod 31 is preferable to be configured to contact a stopper or the like at the fully open position and the fully closed position so that the same cannot be rotated further.

An operating angle of the valve rod 31 from the fully open position to the fully closed position is determined according to a length in a circumferential direction of the flow adjusting groove 42. Although the operating angle in the illustrated example is about 180 degrees, the same can be set to be 180 degrees or less by means of shortening a length of the flow adjusting groove 42 shorter than the illustrated case and vice versa.

In this case, since the flow adjusting groove 42 is formed such that the groove width thereof gradually narrows toward the tip end side while the groove depth gradually shallows at the same time, in comparison with that only the groove depth gradually shallows while the groove width remains constant, a variation of the valve opening extent in relation to the operating angle of the valve rod 31 can be set to be large and the valve opening extent is adjusted with ease.

Thus, the flow of the fluid discharged through the throttle valve 3 can be adjusted by means of adjusting the valve opening extent while rotating the valve rod 31 of the variable throttle valve 3, and a moving speed of the piston 13 at a time when the cushioning action is created, can be controlled.

In addition, since the throttle valve 3 is constructed such that the flow is adjusted by means of only rotating the valve rod 31 around the axis line M in the valve hole 30, the variable throttle valve can be constructed at a compact and simple structure with small number of parts in comparison with the conventional variable throttle valve that advances and retreats the valve rod 31 in the direction of the axis line M, and the variable throttle valve can be compactly assembled in the fluid pressure cylinder.

Incidentally, in the illustrated embodiment, although the piston 13 is configured to stop at the end of the retreating stroke in the buffered manner by means of providing the throttle valve 3, the cushion chamber 20, and the sealing member 16 at a head side (a side of the end wall 10*a*) of the fluid pressure cylinder 2, the piston 13 can also be configured to stop at an end of the advancing stroke in the buffered manner by means of providing these throttle valve 3, the cushion chamber 20, and the sealing member 16 at a rod side (a side of the end cover 12). Alternatively, the cushioning action may be exerted to both ends of the stroke of the piston 13 by means of providing these throttle valve 3, the cushion chamber 20, and the sealing member 16, at both the head side and the rod side.

In addition, in a case that the cushion chamber and the sealing member are provided at the rod side, it is sufficient to attach the cushion packing 25 while causing the rod insertion hole 23 of the end cover 12 to serve as the cushion chamber, and is sufficient to attach a sleeve-shaped sealing member around an outer periphery of the piston rod 14.

FIG. 7 shows a main part of a fluid pressure cylinder apparatus having a throttle valve in the second embodiment, and in the cylinder apparatus 1B of the second embodiment, a variable throttle valve 43 attached to the fluid pressure cylinder 2 is provided with a function as a speed control valve for controlling a moving speed of the piston.

Although the throttle valve 43 has substantially the same construction as the throttle valve 3 in the first embodiment, different from the case of the first embodiment, the first flow path hole 33 that opens at a side face of the valve hole 30 is allowed to communicated with a port 44, and the second flow path hole 34 that opens at a bottom face of the valve hole 30 is allowed to directly communicate with a pressure chamber 45. Further, the cushion chamber and the sealing member in the first embodiment are not provided.

Incidentally, although the second flow path hole 34 has the same size as that of the small diameter hole portion 30*a* of the valve hole 30, the same may be smaller than the small diameter hole portion 30*a*. Further, the port 44 may be located at a position indicated by a dashed line.

Since the construction of the second embodiment other than the above-described construction is the same as that of the first embodiment, the same numerals are attached to the same main portions as those in the first embodiment and explanations thereof are omitted.

In the cylinder apparatus 1B of the second embodiment, a flow of the pressurized fluid supplied from the port 44 to the pressure chamber 45, or discharged from the pressure chamber 45 to the port 44 is adjusted by means of the throttle valve 43, and the piston is driven in a reciprocating movement at a speed corresponding to the adjusted flow.

The throttle valve 43 can be provided at both of a head side and a rod side, or can be also provided either at the head side or at the rod side.

In the throttle valves, 3 and 43, of each of the embodiments, although the valve hole 30 and the valve rod 31 are provided with the large diameter portion and the small diameter portion, respectively, these valve hole 30 and the valve rod 31 may have a uniform diameter over an entire length thereof, as the third embodiment shown in FIG. 8. The third embodiment represents the throttle valve 3 that functions as a cushion valve. In the throttle valve 3, the valve hole 30 is formed to have the uniform diameter over the entire length, and a step portion 32 is formed at a bottom face of the valve hole 30 by means of forming the second flow path hole 34 at the bottom face of the valve hole 30 at a diameter smaller than that of the valve hole 30. In the valve hole 30, the valve rod 31 formed to have the uniform diameter over the entire length is inserted, and the tip end thereof is in contact with the step portion 32 and hooked thereon. Thereby, the valve rod 31 is rotatably attached in the valve hole 30. A device for hooking the valve rod 31 in the valve hole 30 is the same as that of the case in the first and second embodiments.

Incidentally, although the throttle valve 3 is used as a cushion valve in the first embodiment and the throttle valve 43 is used as a speed control valve in the second embodiment, both of the throttle valve 3 for the cushion and the throttle valve 43 for speed control can be provided in one fluid pressure cylinder 2 in a parallel manner.

The invention claimed is:

1. A fluid pressure cylinder apparatus having a throttle valve, comprising:

a piston moving in an inner part of a cylinder body by action of fluid pressure;

a pressure chamber for exerting the action of the fluid pressure on the piston;

a port for supplying or discharging a pressurized fluid to the pressure chamber; and a variable throttle valve for adjusting a flow of the pressurized fluid so as to control a movement of the piston, wherein the variable throttle valve includes a cylindrically shaped valve rod housed in a circular valve hole formed in the cylinder body in a condition of being hooked in a direction of a center axis line of the valve hole, while being rotatable around the center axis line, wherein the valve hole comprises a relatively small diameter hole portion with a fixed hole diameter and a relatively large diameter hole portion with a fixed hole diameter, and a first flow path hole and a second flow path hole through which the pressurized fluid passes that are opened at a side face and a bottom face of the small diameter hole portion, wherein the valve rod comprises a main shaft portion having a relatively small diameter, which fits into the relatively small diameter hole portion of the valve hole, and an operating portion having a relatively large diameter, which fits into the relatively large diameter hole portion of the valve hole in a non-protruding condition, and the valve rod is configured such that an outer peripheral surface of the main shaft portion is formed to be in close sliding contact with an inner peripheral surface of the small diameter hole portion, a connecting hole including a first hole opening at one end is opened at a side face of the main shaft portion and is allowed to communicate with the first flow path hole, and a second hole opening at the other end is opened at a bottom face of the main shaft portion and is allowed to communicate with the second flow path hole is formed in an inner part of the valve rod, the valve rod further comprising a flow adjusting groove for adjusting a connected square measure of the first flow path hole and the first hole opening along with a rotating operation at an outer periphery of the main shaft portion of the valve rod, and an operating hole in which a tool is inserted when performing the rotating operation at a top face of the operation portion, and wherein the flow adjusting groove extends in a circumferential direction from a position of the first hole opening as a base end and a groove width gradually narrows toward a tip end side and a groove depth gradually shallows at the same time.

2. The fluid pressure cylinder apparatus having a throttle valve according to claim 1, wherein the variable throttle valve is provided with a function as a speed control valve for controlling a moving speed of the piston, and wherein either one of the first flow path hole or the second flow path hole is allowed to communicate with the port, and the other is allowed to communicate with the pressure chamber.

3. The fluid pressure cylinder apparatus having a throttle valve according to claim 1, wherein a device for hooking the valve rod in the valve hole is a hooking member composed of a ring-shaped stopping ring.

4. The fluid pressure cylinder apparatus having a throttle valve according to claim 3, wherein the variable throttle valve is provided with a function as a speed control valve for controlling a moving speed of the piston, and wherein either one of the first flow path hole or the second flow path hole is allowed to communicate with the port, and the other is allowed to communicate with the pressure chamber.

5. The fluid pressure cylinder apparatus having a throttle valve according to claim 3, wherein the throttle valve is provided with a function as a cushion valve for stopping the piston at an end of a stroke in a buffered manner, and when the piston approaches the end of the stroke, a fluid in the pressure chamber at a discharge side is discharged from the port through the throttle valve.

6. The fluid pressure cylinder apparatus having a throttle valve according to claim 5, wherein a cushion chamber is formed in an inner part of the cylinder body, wherein when the piston is in the middle of the stroke, the cushion chamber is allowed to communicated with the pressure chamber, whereas the cushion chamber is interrupted from the pressure chamber when the piston approaches the end of the stroke, and wherein the port is allowed to communicate with the cushion chamber, and one and the other of the first flow path hole and the second flow path hole of the throttle valve are respectively allowed to communicate with the cushion chamber and the pressure chamber.

7. The fluid pressure cylinder apparatus having a throttle valve according to claim 1, wherein the throttle valve is provided with a function as a cushion valve for stopping the piston at an end of a stroke in a buffered manner, and when the piston approaches the end of the stroke, a fluid in the pressure chamber at a discharge side is discharged from the port through the throttle valve.

8. The fluid pressure cylinder apparatus having a throttle valve according to claim 7, wherein a cushion chamber is formed in an inner part of the cylinder body, wherein when the piston is in the middle of the stroke, the cushion chamber is allowed to communicated with the pressure chamber, whereas the cushion chamber is interrupted from the pressure chamber when the piston approaches the end of the stroke, and wherein the port is allowed to communicate with the cushion chamber, and one and the other of the first flow path hole and the second flow path hole of the throttle valve are respectively allowed to communicate with the cushion chamber and the pressure chamber.

* * * * *